US005904056A

United States Patent [19]

Ozaki

[11] Patent Number: 5,904,056

[45] Date of Patent: May 18, 1999

[54] COMBINATION TETHER AND LOCKING DEVICE

[76] Inventor: Ron Ozaki, P.O. Box 34, Durango, Colo. 81302

[21] Appl. No.: 08/799,445

[22] Filed: Feb. 13, 1997

[51] Int. Cl.[6] ..... E05B 73/00

[52] U.S. Cl. ..... 70/18; 70/30; 70/49; 70/58

[58] Field of Search ..... 70/14, 18, 19, 70/30, 49, 57, 58; 280/637, 814

[56] References Cited

U.S. PATENT DOCUMENTS

| | | | |
|---|---|---|---|
| 3,518,853 | 7/1970 | Bolte | 70/58 |
| 3,796,438 | 3/1974 | Zimmet | 280/637 X |
| 3,826,510 | 7/1974 | Halter | 70/18 X |
| 4,055,973 | 11/1977 | Best | 70/58 |
| 4,231,586 | 11/1980 | Krause | 70/58 X |
| 4,783,979 | 11/1988 | Weiss | 70/18 X |
| 4,979,382 | 12/1990 | Perry | 70/58 |
| 5,026,088 | 6/1991 | Stuart | 280/637 |
| 5,154,072 | 10/1992 | Leyden | 70/18 |
| 5,181,402 | 1/1993 | Faessler et al. | 70/18 |
| 5,228,319 | 7/1993 | Holley et al. | 70/58 |
| 5,279,135 | 1/1994 | Leyden et al. | 70/18 |

*Primary Examiner*—Suzanne Dino Barrett
*Attorney, Agent, or Firm*—Donn K. Harms

[57] ABSTRACT

A combination snowboard tether, security lock, and carrying strap featuring a metal cable permanently or removably attached to a snowboard. The device may be permanently or removably secured to a snow board. The cable during use as a tether is maintained in a relatively upright position out of the snow and away from rocks and branches using positioning locators mounted on the cable in a fashion to limit the rotation of the cable when inserted into cooperating receiving cavities or notches for the positioning locators located in an eye bolt attached to the snowboard. The device has a lock mounted upon the ends of the cable to allow for the cable to be secured around a stationary object during periods when the board is not being used. The cable may also be used as a carrying strap by positioning it over the shoulder.

22 Claims, 3 Drawing Sheets

COMBINATION TETHER AND LOCKING DEVICE

BACKGROUND OF THE INVENTION

1. Field of the Invention

This invention relates to an easily manufactured and installed tether or leash and locking device for sports boards. More particularly it relates to an easily manufactured and installed cable leash device which doubles as a security lock which can be easily mounted and dismounted upon on snowboards and similar sports type boards such as skate boards.

2. Prior Art

A favorite sport of many persons about the globe and the subject of a constant quest to achieve better performance is the sport of snow boarding where the a wide, flat, elongated runner much like a ski, sled, or other runner type device it is ridden down a snow covered hill by the rider. Unlike skiing where the rider of the ski uses ski boots which restrict ankle motion and are mounted inside releasable binding, snowboarding requires constant motion of knees and ankles to maintain the rider's balance and perform tricks and maneuvers on the board.

Inherent to a sport where the rider slides down a steep hill maintaining his balance while performing maneuvers and tricks are the falls that occur. During such falls the board tends to become separated from the rider necessitating some form of leash or tether connecting the rider to the board to maintain the board in an easy proximity to the rider when they become separated. There is also a need for a device to secure the board from possible theft when not in use and out of possession of the user such at the times the user may be inside the ski lodge for rest or lunch.

A number of devices have developed over the years have been developed for securing skier to their skis during falls and to lock the skis to stationary object during non use. However most such devices have been developed with the skier in mind rather that the more recently developed sport of snow boarding. Skiers normally wear ski boots which fit very tightly around the foot and ankle with the intent to limit movement of the foot and ankle when the individual boots are mounted to the two separate skies during use. Snowboarders however wear two fairly loose fitting snowboard boots or in some cases plain shoes with the intent to allow flexibility of the ankle and foot while riding the board. Thus, snowboarders using snowboards achieve angles to the board and the ground with their legs by bending their ankles, knees, and hips in their effort to turn, perform tricks, and maneuver the board down the hill.

Further, skiers maintain their feet inside their ski boots and on both skis while in line for, or, mounting a ski lift to take them up the hill the be conquered. This is done using ski poles to push or by shuffling one ski in front of the other. Snow boarders must remove one foot, usually the rear foot, to and propel themselves forward to the lifts and to provide forward motion on flat surfaces.

As a consequence of this need for flexibility, and differing lift line and flat surface movement requirements, prior developed tight fitting leashes developed for skis do not function well if at all with snowboards.

Another consequence of modern snowboarding's use of composite materials for board construction has been a steep rise in the cost of snowboards. High cost has the unintended yet prevalent result of the theft of snowboards left unattended during non use by riders by less than honest persons.

As a consequence snowboard riders must pay to lock their boards up in lockers or security locker for the boards during non use periods or risk theft by ever present persons looking for the opportunity to abscond with unprotected equipment.

A further need exists because of the weight of modernly used snowboards. Such board can weigh from fifteen to thirty pounds and carrying them under one arm or hand can become tiresome. Thus it is highly desirable for the tether device to double not only as a security device but also as a carrying strap.

U.S. Pat. No. 4,231,586 (Krause) teaches a combination ski lock and safety strap which attaches to the skiers boot with using a strap and to the ski using a ring commonly found upon ski bindings. However, Krause is made of multiple pieces including a small metal piece which must be assembled and disassembled to change from a tether to a lock which is especially hard when wearing gloves in the cold. Further assembly and disassembly invariably caused loss of parts which would render the lock non functional.

Other shortcomings of Krause are evident. As a security device, Krause is easily overcome with scissors since the webbing used in the construction is easily cut. As a carrying strap, Krause would generally be too short of function effectively. Finally, Krause, while having sufficient slack for use on ski boots which do not bend, could inhibit the constantly moving ankle and foot of a snowboarder.

U.S. Pat. No. 3,826,510 (Halter) teaches an apparatus combining a ski lock and safety strap for use on skis. As taught, Halter requires wrapping a cable around the ski boot of the rider and attaching the cable to a standard ring of a binding. Halter teaches wrapping the cable around the leg to achieve a short amount of cable at the rear of the boot.

Such an arrangement would not work well with the soft boots and shoe worn by snowboarders. While ski boots provide support and protection from chaffing and constriction of the cable during riding, soft boots or shoes commonly worn by snowboards provide no such protection. Halter as taught would has the potential to bruise the snowboarder and to cut or scuff the shoes worn by the rider. Further, the short cable attachment taught by Halter would not allow the maximum flexibility and movement required in snowboarding of ankles and feet.

U.S. Pat. No. 5,026,088 (Stuart) teaches a snowboard safety strap. However, Stuart as taught requires a permanent attachment of the device to the snowboard and a separate padlock to be carried by the rider if the device is to be used for security. Such an arrangement would preclude the use of the device on multiple boards owned by the rider and with the padlock being carried separately raises the possibility of losing it and rendering the security aspects of the invention useless at the ski lodge where padlocks may not be easily purchased.

U.S. Pat. No. 4,685,697 (Thorley) teaches a retractable ski leash and dual purpose lock. Thorley as taught requires permanent attachment to the ski and has a short tensioned cable which may work well with a rider wearing ski boots but has potential abrasion and injury problems to riders of snowboards wearing soft boots.

As such, their exists a need for an easily and inexpensively manufactured apparatus which would function as a combination tether, security device, and carrying strap for recreational elongated runners such as snowboards, skis, surfboards, and the like. Their exists a further need for such a device which can be easily converted from use as a tether to a security device in the cold working climate users encounter while wearing gloves without requiring disassembly and assembly of small parts. An additional unmet need which should be provided to the allowance of sufficient slack and movement of the device when used as a tether by snowboarders requiring maximum flexibility, while concurrently providing for the apparatus to maintain a position upright and out of the snow and away from branches and rocks encountered on ski slopes to avoid snagging. Another need remaining unmet with such a combination device is the ability to easily mount the device upon more than one snowboard to avoid duplication of purchase by one rider having more than one board.

Finally, a further need exists for a combination lock and tether which maintains the tether above the elongated ski or snowboard and out of the medium the rider is navigating.

SUMMARY OF THE INVENTION

Applicant's device is an easily manufactured and used device for both the retainment of an elongated runner such as a snow board or other sports board in a proximity to the user should the board become separated from the users body during use while allowing maximum flexibility to the rider in foot body movement while riding the board. It is also easily mounted and dismounted on multiple boards to secure the board from possible theft when left unattended during non use.

In use during sporting activities of the user the device is secured to the users leg using a strap attached to a non elastic cable portion of the invention. The cable is maintained in a relatively vertical position to the sports board by insertion of positioning locator affixed to the cable in a manner to limit rotation of the cable, into a into a notched eyelet or an other receptive device designed to receive the positioning locator. The eye or other mount for receiving the positioning locator is attached to the sports board through existing holes for bindings or a mounting hole placed in the board, at a desired position, for that purpose. Conventional leash devices which can drag through the snow or water and affect the users balance and ride on the sports board. Since the positioning locator when inserted into a cooperating receiving device allows the relatively vertical position of the cable being maintained in a relatively upright to the sports board the device provides the advantage of keeping the cable out of the snow or water during maneuvers in such by the user.

As a security device, the device offers users the flexibility of being able to lock a snow board, ski, or surfboard, to any stationary mount such as a bench, fence, pole, specially provided mount, or otherwise. This precludes less than honest persons from easy removal of the board while the user has left it to eat or rest. The device as taught herein uses a two piece combination lock having one of each pieces mounted to the cable. While this is the best embodiment to date, other locking devices may be used to secure the two cable ends to each other in a secured fashion. In use as a security device, the user simply detaches the flexible strap portion of the device which is attached to the cable, from their leg, unlocks the lock attached to the cable and relock it around the device to be used.

In summary, the present invention is an improvement over devices now in use and known in prior art. It is novel and satisfies a long unmet need for an easily and inexpensively manufactured combination sports board leash or user proximity maintenance device and security lock during non use of the sports board.

The preferred configuration of the best current embodiments of the invention feature a non elastic steel or metal cable which is inherently non corrosive such as stainless steel or galvanized steel. The cable is flexible yet when bent it flexes provides a resistance or bias in opposition to being bent which is an inherent characteristic of most wire rope and cable. A curl may be placed in the cable much like a telephone chord should stretch or other characteristics of a curled cable be desired. Both ends of the cable attach to a locking device such as an in line combination lock or keyed lock which is secured to an eye bolt or similar mounting device permanently mounted on the sports board. By placing registration or positioning slots in the inside diameter of the eye bolt a cable positioning locator mounted upon the cable or lock may function in a cooperating arrangement to limit the rotation of the cable. The attached cable is thus maintained in a position relatively upright or perpendicular to the sports board during out of the snow or water through which the user is navigating the board. This eliminates the drag and possibilities of snagging rocks, branches and other hazards which exist with current "leashing" systems for such sports boards.

The device is also easily converted to a carrying strap for the board by inserting the user's arm through cable when the lock is closed and over the shoulder.

An object of this invention is provide an easily used and maintained leash tether removably attachable to a snowboard which will maintain the board in a proximity to the user should the user fall off the board.

Another object of this invention is to provide the additional benefit of a leash or tether to a snowboard or other sports board which maintains a position during use which is out of the snow or water.

A further object of this invention is to provide users with an easily installed original equipment or after market device for use as a tether which can be quickly and easily installed on a variety of snowboards and may be used on more than one board by the easy attachment and dis attachment therefrom.

An additional object of this invention is to provide users with an easily installed original equipment or after market device for use as a lock to secure snowboards and sports boards such as surfboards or skateboards during periods of non use which is not easily cut or overcome.

A further object of this invention is to provide the aforementioned benefits in an easily and cheaply manufactured device which is easily adaptable to a wide range of sports boards such a snow boards, and surfboards.

A further object of this invention is to provide a combination tether and locking device which is easily used in cold climates and does not have easily lost pieces which must be assembled and disassembled during use.

Another object of this multiple use invention is to provide a carrying strap for the attached snowboard when the user is transporting the board.

An additional object of this invention is to provide a tether for a snowboard which provides sufficient slack and movement for the leg and ankle of snowboarders and avoids chaffing or bruising.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENT OF THE INVENTION

Figure 1:
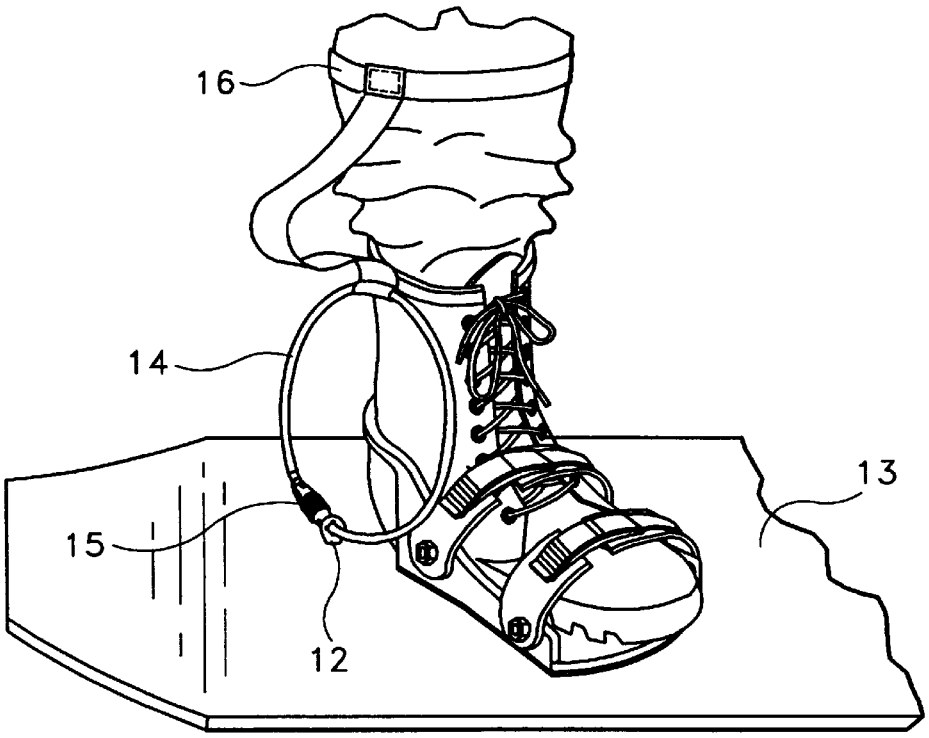
FIG. 1 is a perspective view of the combination tether and locking device in use in a detachably fixed upright position attached to the user's leg.
Figure 2:
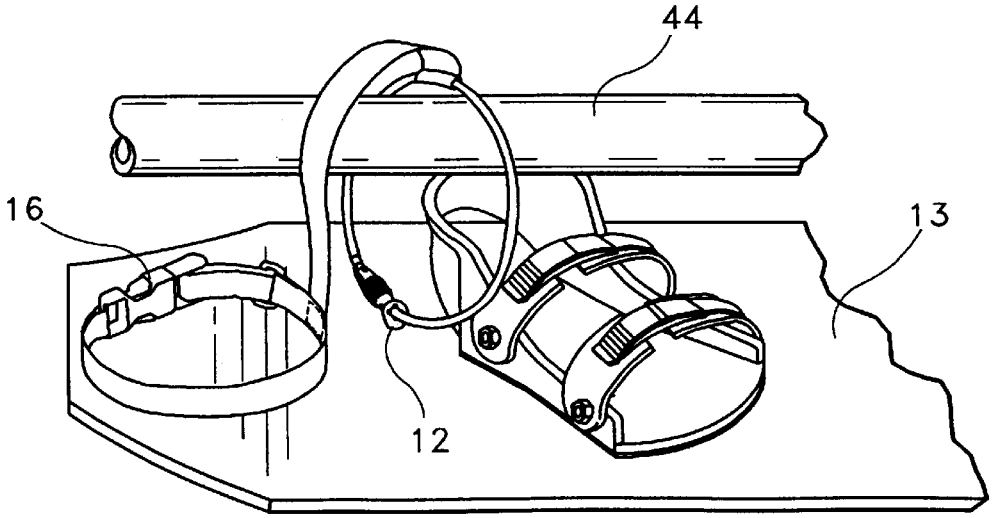
FIG. 2 is a view of the device functioning as a security lock tethering the sports board to a fixed ring commonly found on bike racks.
Figure 3:
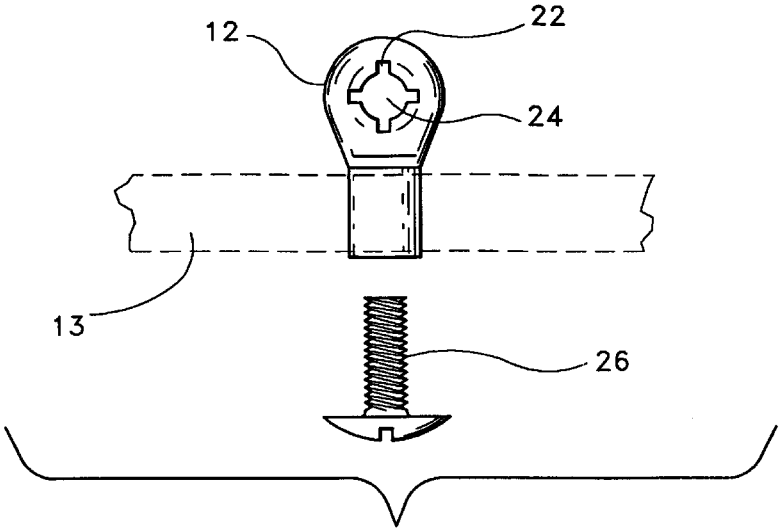
FIG. 3 is a side view of the attachment eye having location notches about its interior eye portion to selectively locate the cable in an upright or horizontal position during use.
Figure 4:
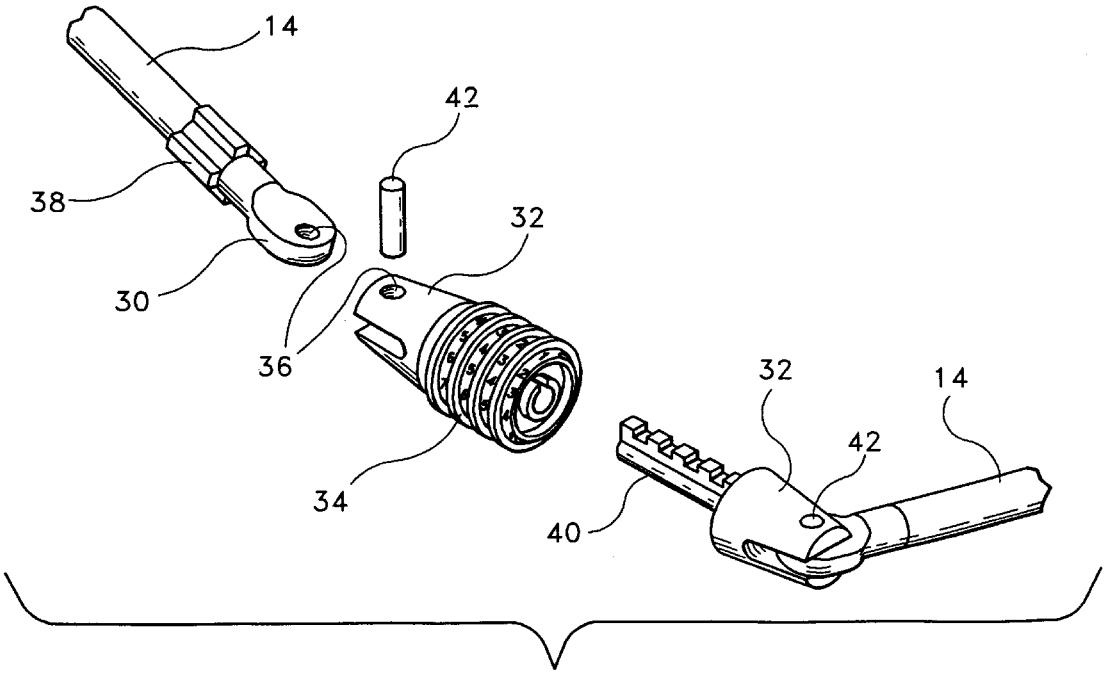
FIG. 4 is a view of the lock portion of the invention which is attached to both ends of a length of wire rope.
Figure 5:
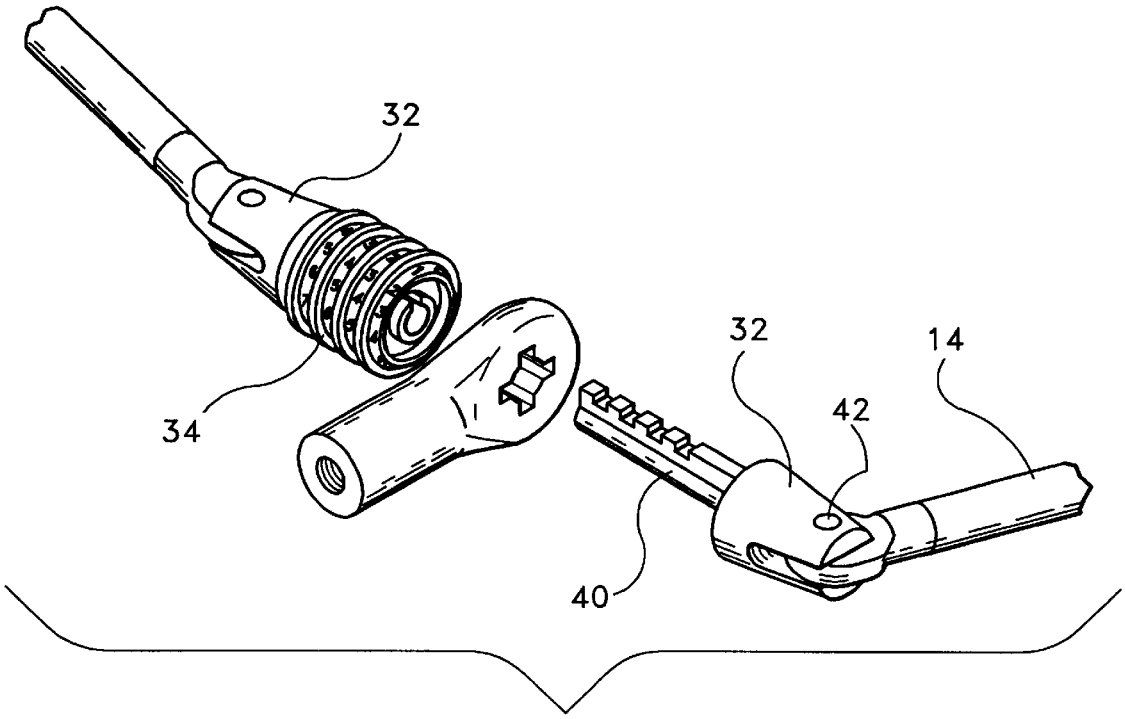
FIG. 5 is a view of the lock portion of the invention in an unlocked state with one end of the cable detached from the lock.

Referring now to the drawing Figures, specifically FIG. 1 depicts the preferred embodiment of the invention featuring the combination tether and locking device 10 during use featuring the securing eye bolt 12 attached to the elongated runner such as a snowboard body 13. While a snowboard 13 is pictured, the combination tether and locking device could be used on other types of recreational elongated runners such as skis or surfboards. A cable 14 is removably secured to the eye bolt 12 and also to the leg of the user with a releasable leg attachment 16 with a conventional cooperating fastener mounted thereon to allow for easy on an off of a user's leg. The metal cable 14 functions best if made from non corrosive such as stainless steel or galvanized steel material. The cable 14 can optionally have a protective coating such as nylon or polyester (not shown) about its outside perimeter for further protection from water and the air and the corrosive factors encountered during use.

A preferred construction of the cable 14 should allow it to be flexible yet sufficiently rigid to maintain its position relatively upright to the elongated runner or snowboard 13 when in use by one riding the snowboard 13. Wire rope having a construction of seven strands each having seven strands or seven strands each made up of nineteen strands is conventionally manufactured and exhibits the qualities desired, however cable used in manufacture may vary among other conventional wire rope and cable constructions. While the cable 14 is pictured in a flat or relatively straight arrangement with the snowboard 13, a curled or similar cable might be used should the user desire more stretch as a leash or just to maintain a lower profile.

The releasable leg attachment 16 could be made of conventional strap material such as nylon or polypropylene webbing and use conventional strap releasable cooperating attachments such as plastic or nylon cooperating clips or hook loop such as Velcro® material to secure the leg attachment 16 around the leg of the user.

Should the user fall from the sports board 13 while riding it, the board 13 will remain in a proximity to the user as the leg attachment 16 connected to the cable 14 attached to the eye bolt 12 secured to the sports board 13 will act as a leash or tethering system. Board mounts other than an eye bolt might be used such as a clip or specially designed mount so long as they have notches or some other manner to maintain the cable in a relatively upright position to the recreational runner snowboard 13 during use as a leash.

The securing eye bolt 12 features cable positioning notches 22 placed about the perimeter of the aperture 22 of the securing eye bolt 12. More or less notches could be used and the positioning notches could be on the side, or outside of the eye bolt 12 if the cooperating cable positioning locator 38 is designed to cooperate with the eye 12 or other conventional mount to maintain the cable upright in use as a tether. The securing eye bolt 12 is attached to the sports board 13 through a hole (not shown) in the board through which the securing eye bolt 12 is fixed into the hole and onto the sports board 13 with a mounting nut 26. The mounting nut 26 depicted would be threaded about its exterior and would screw into a cooperating threaded cavity about the interior of the securing eye bolt 12 in a conventional screw and nut attachment relationship. The nut should be mounted such that it is recessed from or flush with the bottom surface of the sports board 13 so as it will not drag in the snow or water and should not be easily removable by anyone other than the user or authorized persons. Conventionally such security type nuts are of a shape not easily removed without a special wrench or have indentations on them rendering them not easily rotated and removed without special wrenches to fit those indentations. The nut 26 could also be hidden by placing a relief in the bottom of the sports board 13 for the larger head portion of the nut and then covering the relief with resin, pigment, or other conventional sports board coatings after the nut is inserted and secured to the eye 12 thus restricting access to the nut by hiding it.

The cable positioning notches 22 are shaped to accept cooperating cable positioning locators 38 which are located upon the cable 14 or the lock 15. During use as a sports board tether the user would locate the cable positioning locators 38 into the positioning notices 22 by insertion therein such that the flexible cable 14 would maintain a upright position to the sports board 13 and out of the snow or water which the user is navigating. By securing the cable positioning locators to the cable 14 by swagging them on the cable, or to some attached hardware connected to the cable by swagging or other conventional methods, in a fashion to limit the rotation of the cable, an upright position can be maintained as determined by the relationship of the cable positioning locator 38 inside the receiving cable positioning notches 22.

The cable 14 would have conventional wire rope attachments such as a conventional hinge arrangement 30 with the wire rope end swagged or otherwise conventionally attached to the ends of the cable 14. The hinge wire rope end 30 would be inserted into a cooperating wire rope end receiving attachment shoulder 32 and has depicted in the current preferred embodiment, would swivel and be maintained therein upon a rivet or screw 42 inserted through cooperating apertures 36 located in the wire rope end 30 and the receiving attachment shoulder 32.

Thus, when cable positioning locators 38 are removably inserted into the notches 22 the natural rigidity of the cable tends to maintain the cable 14 in a position relatively upright or perpendicular to the sports board 13. While the invention may work without the notches 22 and by just securing the cable 14 to the user's leg with the releasable leg attachment 16, it performs better with when cable positioning locators 38 which are swagged or otherwise located in a stationary location on the cable 14 or the lock 15 or the hardware attached to the cable ends, and inserted into the locators 38 to limit rotation of the cable 14 to maintain the upright position.

The lock in the preferred embodiment is similar to conventional locks used for bicycles and other sports equipment in that it is a combination type lock 15 having tumblers 34 which when aligned in the proper sequence will allow for the removal of a notched lock tumbler insert 40 from the tumbler portion. Other locks could be used such a keyed lock however the combination lock offers the convenience of no requirement of keys to carry or lose.

The cable positioning locator 38 can be fashioned of metal in a shape designed to co operatively engage the notches 22 when inserted through the aperture 24 of the eye 12. The cable positioning locator 38 can be swagged upon the cable in a fixed position, swagged or cast upon the wire rope end 30, it could be formed part of the lock wire rope end receiving attachment 32 or could be formed by shaping the lock tumbler insert 40 to a cooperating shape with the notches 22. Depending on the design other manners of formation and engagement of the cable positioning locator 38 are anticipated. In any case, the cable positioning locator needs to be attached such that it will maintain the wire rope 14 in a manner such that it cannot rotate in the eye 12 and thus uses the natural properties of conventional wire rope to maintain a certain plane when bent into a circular fashion.

In use as a security device the cable 14 is separated by opening the conventional cable mounted combination lock 15 and then rejoined around a stationary object such as a bench or fence or pole by rejoining the two ends of the cable when the lock 15 is locked.

The combination tether and locking device may be used on multiple boards if the eye 12 or other conventional mount is fashioned in a manner to cooperate with a positioning locator 38 located on the lock tumbler insert 40. In this fashion, the lock tumbler insert 40 would be shaped and sized to fit in a cooperating relationship when inserted through the cable positioning notches 22 in the eye 12. Rejoining the tumbler insert 40 with the female tumbler insert portion of the combination lock 34 on the opposite side of the eye 12 secures the device to the board 13 on which the eye 12 is mounted.

Figure 6:
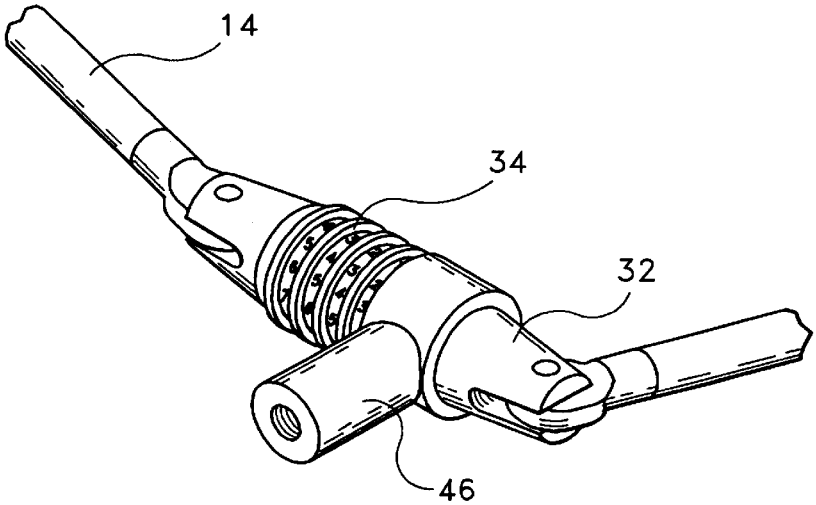
FIG. 6 is another view of a locking device in an unlocked state and secured to the cable.

FIG. 6 features a mount 46 attached to one shoulder 32 of the lock assembly 34 which is attached to the ends of the cables with conventional hinges or pins in a conventional swivel relationship. Such a configuration would make the securing eye bolt 12 unnecessary since the combination lock would be mounted on the attached shoulder. The cable ends would have a conventional wire rope swivel swaged upon them which would be mounted into the shoulder 32 by a hinge pin 42 press fit in such a manner that they would be hard to remove. Alternatively, the cable ends could be swagged into the shoulder 32 itself is configured to accept a cable and thus eliminate the conventional hinge arrangement. The cable would be swagged into the shoulders 32 of the lock 15 and the cable formed to a desired shape to maintain its relative upright position in relation to the board 13 in use. Further, by mounting the cable positioning locator 38 in a manner to position the cable upright in use, or by maintaining the cable upright in use with the strap 16 it would be possible to use a cable 16 with eyes at the ends and a conventional padlock. Depending upon the configuration desired by the user other modes of cable securing are possible other than the current best embodiments pictured.

While all of the fundamental characteristics and features of the aperture for alteration of the cross sectional area of an intake manifold or chamber invention have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A combination tether and security lock comprising:

a fastener having an eye therethrough, said fastener affixable to an elongated runner;

an elongated cable having a first end and a second end;

a locking means, said locking means attached to both ends of said cable;

said locking means when unlocked being separable into a first locking component and a second locking component;

said locking means securing said first locking component and said second locking component and cable ends together, in a locked relationship with said eye, when said first locking component is locked to said second locking component; and means for releasable attachment of said cable to the leg of a rider of said elongated runner.

2. The invention as defined in claim 1 further comprising;

cable registration means attached to said cable, said cable registration means engageable with said fastener, said attached cable being registerable into a rotationally fixed position at the point of said engagement of said cable registration means and said fastener.

3. The invention as defined in claim 2 wherein said cable registration means comprises:

said eye located in said fastener configured to cooperatively engage an elongated shaft extending from said second locking component;

said first locking component and said second locking component being prevented from rotating when cooperatively engaged through said eye.

4. The invention as defined in claim 2 wherein said registration means comprises:

a cable positioning locator located upon the circumference of said cable; and said eye of said fastener configured to cooperatively engage said cable positioning locator whereby said cooperative engagement of said cable positioning locator and said eye prevents rotation of said cable positioning locator.

5. The invention as defined in claim 2 wherein said cable positioning locator is positioned about said first locking component.

6. The invention as defined in claim 2 wherein said cable positioning locator is positioned about said second locking component.

7. The invention defined in claim 1 wherein said means for releasable attachment of said cable to the leg of said rider is a strap attached to said cable; said strap having two ends and having a cooperating strap fastener attached to each of said two ends of said strap, said cooperating strap fastener being separable into at least two fastener components, whereby said strap may be secured around said leg of said rider by engaging said fastener components and removed from said leg by disengaging said fastener components.

8. The invention as defined in claim 2 wherein said cable registration means is said strap when secured around the leg of said rider.

9. The invention as defined in claim 1 wherein said first locking component and said second locking component are attached to said cable ends in a hinged relationship.

10. The invention as defined in claim 1 wherein said locking means is a combination lock.

11. The invention as defined in claim 1 wherein said elongated runner is a snowboard.

12. The invention as defined in claim 1 wherein said elongated runner is a surfboard.

13. The invention as defined in claim 1 wherein said elongated runner is a ski.

14. The invention as defined in claim 2 wherein said first locking component and said second locking component are attached to said cable ends in a hinged relationship.

15. The invention as defined in claim 2 wherein said locking means is a combination lock.

16. The invention as defined in claim 2 wherein said elongated runner is a snowboard.

17. The invention as defined in claim 2 wherein said elongated runner is a surfboard.

18. The invention as defined in claim 2 wherein said elongated runner is a ski.

19. The invention as defined in claim 1 wherein cable is affixable around a fixed object whereby said elongated runner may be secured to said fixed object.

20. The invention as defined in claim 2 wherein cable is affixable around a fixed object whereby said elongated runner may be secured to said fixed object.

21. The invention as defined in claim 1 wherein said locking means is affixable to any one of a plurality of elongated runners having said fastener mounted thereon.

22. The invention as defined in claim 2 wherein said locking means is affixable to any one of a plurality of elongated runners having said fastener mounted thereon.

* * * * *